United States Patent [19]

Tornya

[11] 4,346,872

[45] Aug. 31, 1982

[54] BALUSTRADE CONSTRUCTION

[76] Inventor: Andrew G. Tornya, 207 Edgecliff Rd., Woollahra, N.S.W., 2025, Australia

[21] Appl. No.: 67,134

[22] Filed: Aug. 16, 1979

[30] Foreign Application Priority Data

Jul. 19, 1979 [AU] Australia ..... 49084/79

[51] Int. Cl.[3] ..... E04H 17/14

[52] U.S. Cl. ..... 256/65

[58] Field of Search ..... 256/65, 68, 69, 22, 256/59

[56] References Cited

U.S. PATENT DOCUMENTS

| | | | |
|---|---|---|---|
| 3,304,683 | 2/1967 | Ferreira | 256/65 X |
| 3,491,984 | 1/1970 | Nyberg | 256/65 X |
| 3,506,243 | 4/1970 | Seiler | 256/65 X |
| 3,522,933 | 8/1970 | Braun | 256/65 X |
| 3,596,880 | 8/1971 | Greenberg | 256/65 |
| 3,879,017 | 4/1975 | Maxcy | 256/65 |
| 3,924,834 | 12/1975 | Young | 256/59 X |
| 4,014,520 | 3/1977 | Walters | 256/65 X |
| 4,073,477 | 2/1978 | Walters | 256/69 |

FOREIGN PATENT DOCUMENTS 477021 1/1975 Australia .

*Primary Examiner*—Andrew V. Kundrat

*Attorney, Agent, or Firm*—Stevens, Davis, Miller & Mosher

[57] ABSTRACT

This invention relates to building construction from pre-fabricated units, and more particularly to the construction of balustrades or the like from extruded components of such materials as aluminium or its alloys.

11 Claims, 14 Drawing Figures

BALUSTRADE CONSTRUCTION

BACKGROUND OF THE INVENTION

It is known to clip together baluster modudules to produce a sub-assembly to which is afterwards clipped a top rail.

Certain disadvantages of the above-mentioned system included the need to punch or drill holes in the modules and the need for a continuous top rail. The present invention dispenses with the need for the formation of holes and the absence of a continuous top rail, at least in one embodiment, ensures that the modules before assembly may be packed into a container and transported with ease, or even supplied in the form of a 'do-it-yourself' kit for subsequent assembly by amateurs or other persons of limited skill. In one embodiment of the invention, described hereinafter, it is merely necessary to instal eight screws to assemble the outside frame of a balustrade. The remainder of the assembly simply clips together without the use of tools.

The invention is also an improvement in certain other prior known systems including that which is the subject of Commonwealth Specification No. 477,021 by Charles G. Young, wherein the clipping method if dependent upon the formation of a baluster of complex section necessary to admit it to an accepting channel, within which it is turned to wedge it between two inwardly-projecting lips of that channel. This arrangement requires the formation of cuts in opposite sides of each baluster, these cuts being made normal to the coacting grooves.

Attempts have been made to improve the last-mentioned arrangement by sliding balusters lengthwise into the upwardly-facing mouth of a channel member forming the bottom rail of a balustrade and then sliding a lid or closure strip into a grooved section of the channel before pressing it up against the 'downstream' end of a last-assembled baluster, and so on. Such a system has suffered from the disadvantage, however, that a gap always existed beside each baluster which tended to admit water and other foreign matter.

SUMMARY OF THE INVENTION

These and other disadvantages are overome, according to the present invention, by the provision of a balustrade unit comprising a pair of spaced-apart channel-section members, the mouths of which are directed towards each other, the free edges of each said channel-section member being bent so as to form a pair of longitudinally-extending flanges, and a pair of spaced-apart, longitudinally-extending engaging elements provided on and upstanding from the base portion of each said channel-section member; a plurality of balusters disposable between said channel-section members, each baluster having, adjacent each end thereof, a transverse slot, the two slots in each baluster being parallel and in register with each other and the ends of said balusters being receivable between said engaging elements when said balusters are in position between said channel-section members; and a plurality of spacers each one of which is extendable between adjacent balusters of said balustrade unit, each said spacer having a table portion the side edges of which are receivable in rebates in said longitudinally-extending flanges, and a pair of valances disposed normal to said table portion and adapted to irremovably engage with said engaging elements when said spacer is disposed between adjacent balusters, each said table portion including a bight the base of which is receivable in a said transverse slot and the limbs of which extend on either side of the baluster to enclose the space between baluster and longitudinally-extending flange.

In one embodiment of the invention, one of the pair of channel-section members may be provided with an integral handrail portion located on that side of the channel-section member remote from the mouth thereof.

In order that the reader may gain a better understanding of the present invention, hereinafter are described certain embodiments thereof, by way of example only, and with reference to the accompanying drawings in which.

Throughout the specification similar integers are referenced by like numerals.

Figure 1:
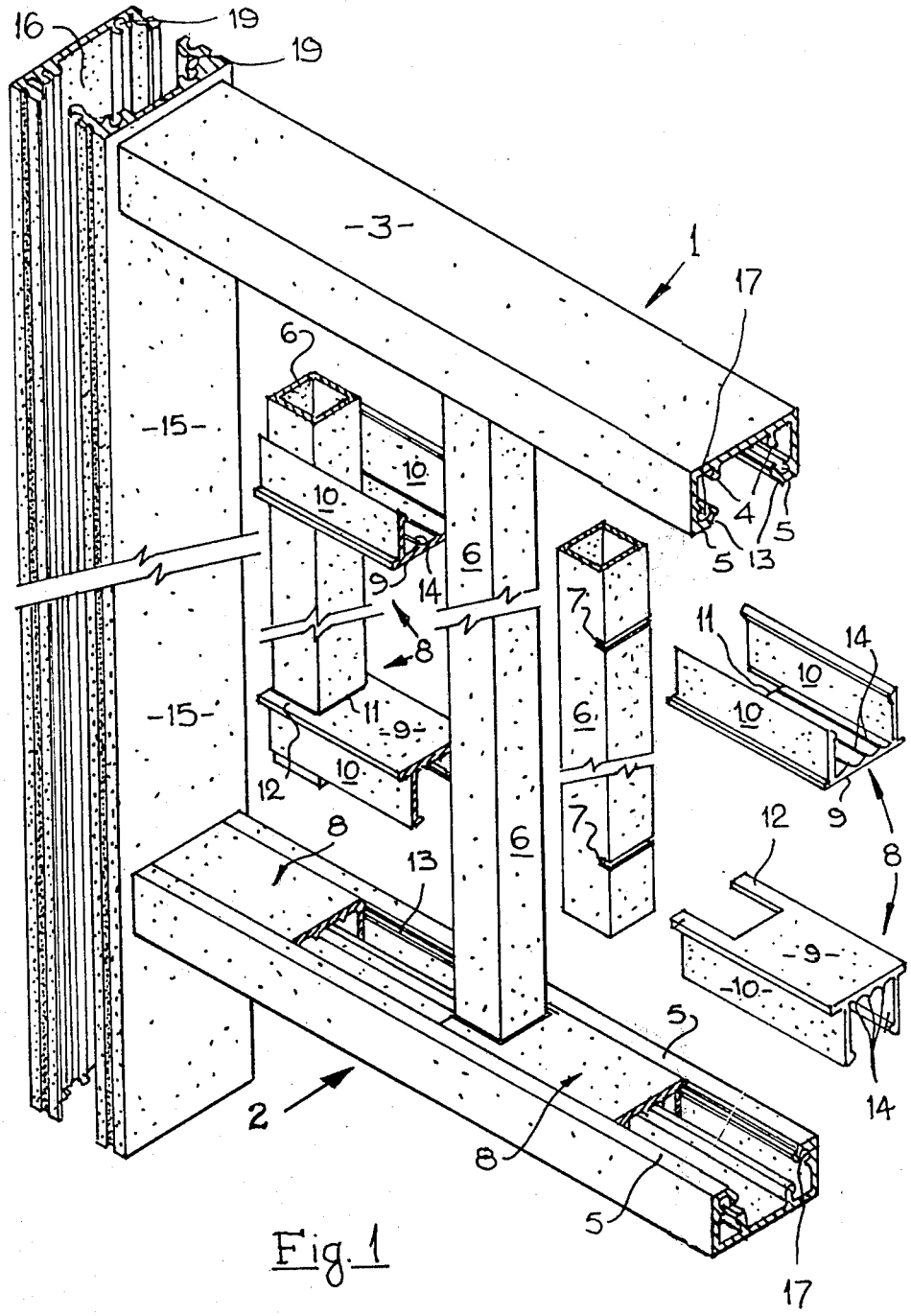
FIG. 1 shows an exploded view of component parts of a balustrade unit according to a first embodiment of the present invention.
Figure 3:
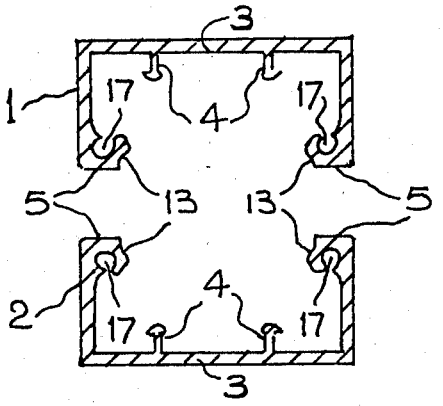
FIG. 3 shows a pair of channel-section members, in cross-section.

In FIG. 1 is seen, in exploded view, a balustrade unit according to a first embodiment of the present invention, which unit has a pair of spaced-apart channel-section members, namely an upper member 1 and a lower member 2. Each channel-section member 1, 2 is preferably an extruded member of aluminium or aluminium alloy, as well may all the other integers or components of the present invention. As may be best seen in FIG. 3, channel-section members 1, 2 are interchangeable and each has a base portion 3 upon which are provided upstanding, longitudinally-extending engaging elements 4. The free edges of members 1, 2 are bent so as to form longitudinally-extending flanges 5. As will be seen, these engaging elements 4 have their free edges of hooked profile, the tip or point of the hook being disposed outwardly; inwardly, the profile preferably has a V-bead or the like along it, and the purpose of hook and bead will be made clear later herein.

Figure 6:
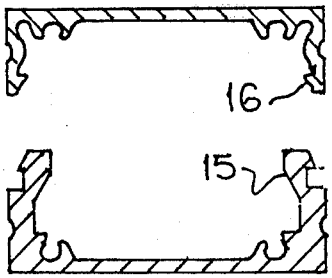
FIG. 6 shows two half-sections of a newel post, in cross-section.

The balustrade unit includes a plurality of balusters 6, advantageously extruded members of square-section as shown in FIG. 6. However, such balusters as 6 could also be formed from timber or other suitable rigid materials if desired, although highly preferred are the square-sectioned balusters of, say $\frac{3}{4}'' \times \frac{3}{4}''$ external dimensions ranging from 1.2 mm hollow core to solid square rod. Balusters 6 may be extrusions freely available from stock normally held by aluminium suppliers. Each baluster 6 has transverse slots 7, one adjacent each end, and it will be appreciated that such may be economically fabricated from stock lengths of extrusion by what is known as a 'supersaw' possessing three saw blades mounted side-by-side with a gap of pre-determined dimension therebetween. Thus, on a single pass of the saw, three cuts are made, the middle cut going right through the extrusion or rod and the two spaced side cuts producing top and bottom slots 7 respectively, so that while positioning the main, i.e. severing cut, with reference to the middle saw blade, the two sides are simultaneously formed, one being in that baluster which is next to be cut off and the other being the finishing slot in that baluster which has just been cut; thereby achieving a major saving in cost. This is contrary to many presently-known systems wherein a hole is formed in a section which is destined to accept a baluster, then the end of the baluster has a co-acting hole formed therein and then, after passing the baluster through the first mentioned hole, a holding cross-screw must be inserted. In the present invention, by contrast, all the forming operations are rapidly done at the time when the balusters are cut from the stock length, so that each one is the same as every other one simply because the spacing is easily made constant between the blades of the 'supersaw'.

The respective ends of each baluster 6 are received between engaging elements 4 of channel-section members 1 and 2, being a fractionally-oversized fit between the V-beads on the inner sides of the engaging elements 4, thus forcing them outwards a trifle for a reason to be later explained herein.

The balustrade unit has a plurality of spacers 8, each one of which is configured to extend between adjacent balusters 6. Each spacer 6 includes a table portion 9, valances 10, and a bight having a base 11 and limbs 12. Table portion 9 of spacer 6 is of a width to fit between flanges 5 of channel-section members 1 and 2, the side edges being received in the longitudinally-extending rebates 13 in channel-section members 1,2 and the valances fitting either side of engaging elements 4. These valances 10 have hooked profiles but in this case the tip or point of the hook is directed inwardly to co-act with the hooked profiles on engaging elements 4, thus producing a positive 'snap-fit' which cannot be disengaged without loss of integrity. The engaging elements 4, having been forced slightly outwards by the insertion therebetween of a baluster 6, are now forced inwards by valances 10 hard against the baluster. Spacer 8 is then pushed into contact with baluster 6 so that base 11 of the bight of spacer 8 is accommodated within transverse slot 7 and the limbs 12 extend on either side to enclose the spaces between baluster 6 and flanges 5. Thus the greater the force tending to pull the baluster out of the channel-section member the more firmly the valances tend to close. In this manner a straight shear loading is imparted to the valances and engaging elements and the assembly tends to behave as a solid or unitary structure which is completely rattle-free, even when located in a windy locality. This system also permits the use of hollow box-section balusters 6 which would otherwise be very difficult to connect to any kind of cross-members without providing the balusters with screw-flutes which reduce the strength and add to the weight of an otherwise ideal section. The absence of screw-fastenings also renders units according to the invention useful in "do-it-yourself" kit form because the top channel-section member 1 is not necessarily continuous.

A further economy in cost may be effected because such spacers 8 may be initially extended in three-abreast format, that is to say, as a single section with very thin portions interspaced with the profiles, permitting the three discrete spacer extrusions to be knocked apart with a hammer or the like, or cut. These triple spacer components can be mated one with another, via the hooked valances, so that only their outer surfaces—their table portions and outwardly-oriented valances need be anodised. Thus instead of incurring a minimum cost of anodising a minimum perimeter of 100 mm each, two triple-spacer sections mated hook-to-hook may be anodised in the full length so that the actual cost of anodising is reduced to that of twice the length of 102.7 mm plus the distance therebetween. This not only cuts anodising costs but provides six spacers per guillotining. Singly, such spacers are difficult to handle commercially but may be handled with much greater facility in the triple-spacer format. That is to say, they may be fed easily into a press which has three guillotine blades as well as, say, three bight-producing punches, thereby ensuring that the feeding into the press of a single length of extrusion causes the press to deliver three separate completed spacers per unit lengths of extruded strip.

Figure 4:
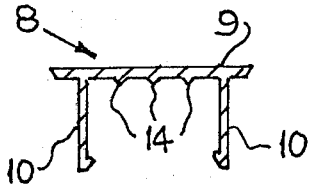
FIG. 4 shows a spacer, in cross-section.
Figure 5:
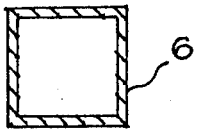
FIG. 5 shows a baluster, in cross-section.

A further anti-rattle feature comprises a set of V-beads 14, best seen in FIG. 4, on the underside of table portion 9 of each spacer 8 which V-beads are slightly flattened on being received in the transverse slots 7, to thus wedge base 11 in slot 7.

A newel post may be provided at each end of such a balustrade unit as has been described above. A suitable kind of newel post is to be seen in FIGS. 1 and 7 particularly. Each newel post is composed of two mating half sections which irremovably engage with each other to form a said newel post. These two mating half-sections take the forms of a 'female' half-section 15 and a 'male' half-section 16. As has been previously described in relation to hooked-profile engaging elements which are a feature of valances 10 and engaging elements 4, the two half-sections 'smap-fit' snugly together to thus constitute a newel post. Each newel post is securable to associated channel section members by conventional self-tapping screws which extend through appropriately-drilled holes in either one of half-sections 15,16 and on into registering screw-flutes in the channel-section members 1,2. Such screw-flutes are integral to the extruded profile and are referenced 17 in FIGS. 1 to 14 of the drawings.

Figure 2:
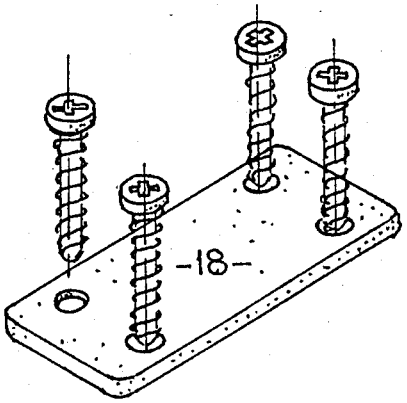
FIG. 2 shows a suitable kind of post capping member.

FIG. 2 illustrates a suitable post capping member comprising a plate 18 having holes therein through which self-tapping screws pass into registering screw-flutes 19 in the male and female half-sections 16,15 of the newel post. However, more preferred is a simple cap of a suitable plastics material with spigots thereon to mate with the said screw-flutes.

Figure 7:
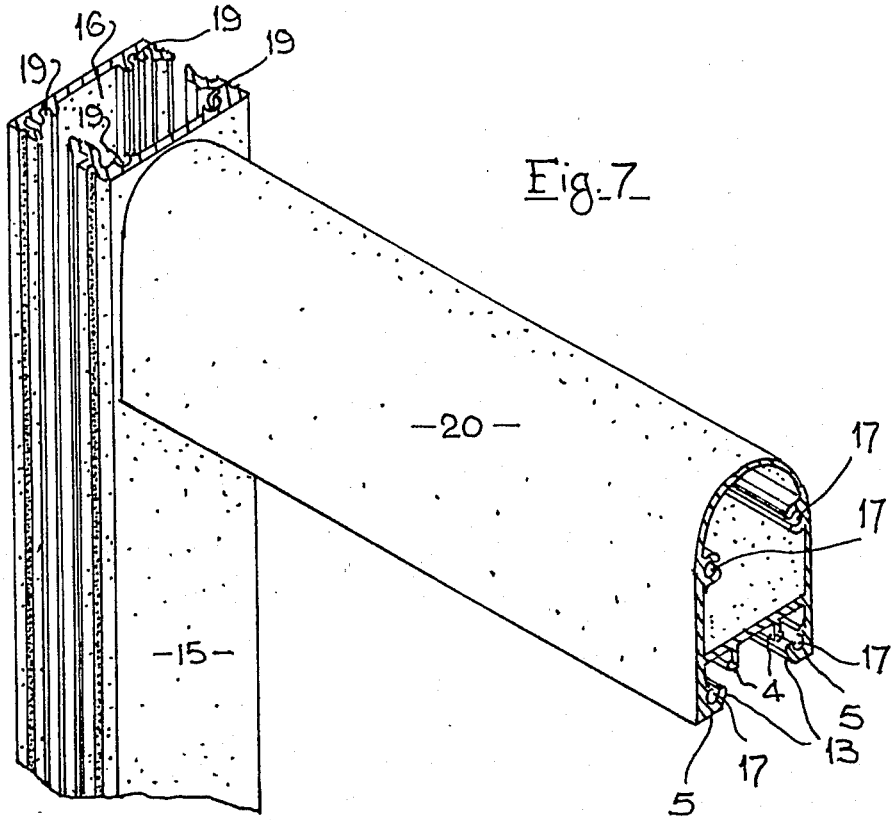
FIG. 7 shows a second embodiment of an upper channel-section member having an integral hand-rail.

FIG. 7 shows a top channel-section member having an arcuate-topped integral handrail portion 20, apart from which the arrangement is just as previously described.

FIGS. 8, 9, 10 and 11 illustrate a modification in which a separate handrail 21 is provided. In this embodiment the top channel-section member has longitudinally-extending flanges 22 which are bent first outwardly and then upwardly and the free edges of the upwardly-turned flange portions are equipped with hooked-profile engaging elements which engage with co-acting hooked-profile engaging elements provided on separate handrail 21, as is best to be seen in FIG. 9. The lower channel-section member 2 is exactly as previously described in relation to FIG. 1.

Figure 12:
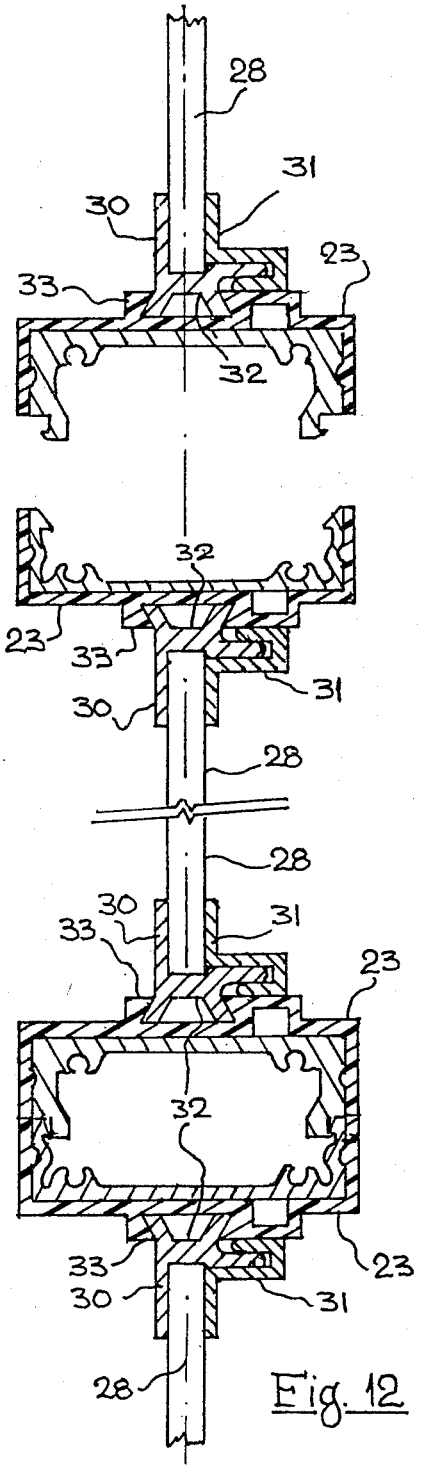
FIG. 12 is a corresponding horizontal section.
Figure 8:
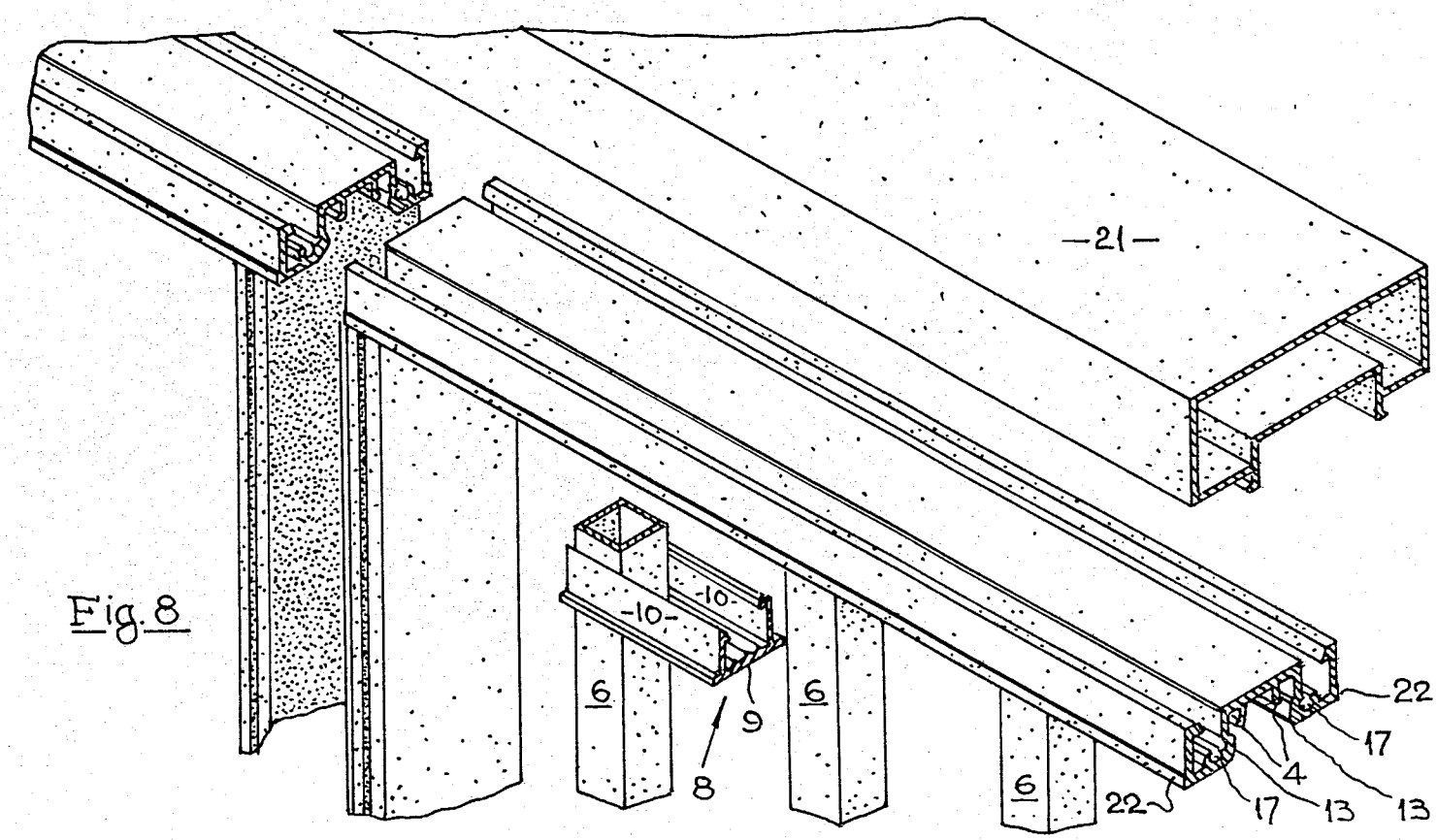
FIG. 8 shows a third embodiment of an upper channel-section member, together with a non-integral handrail therefor.
Figure 9:
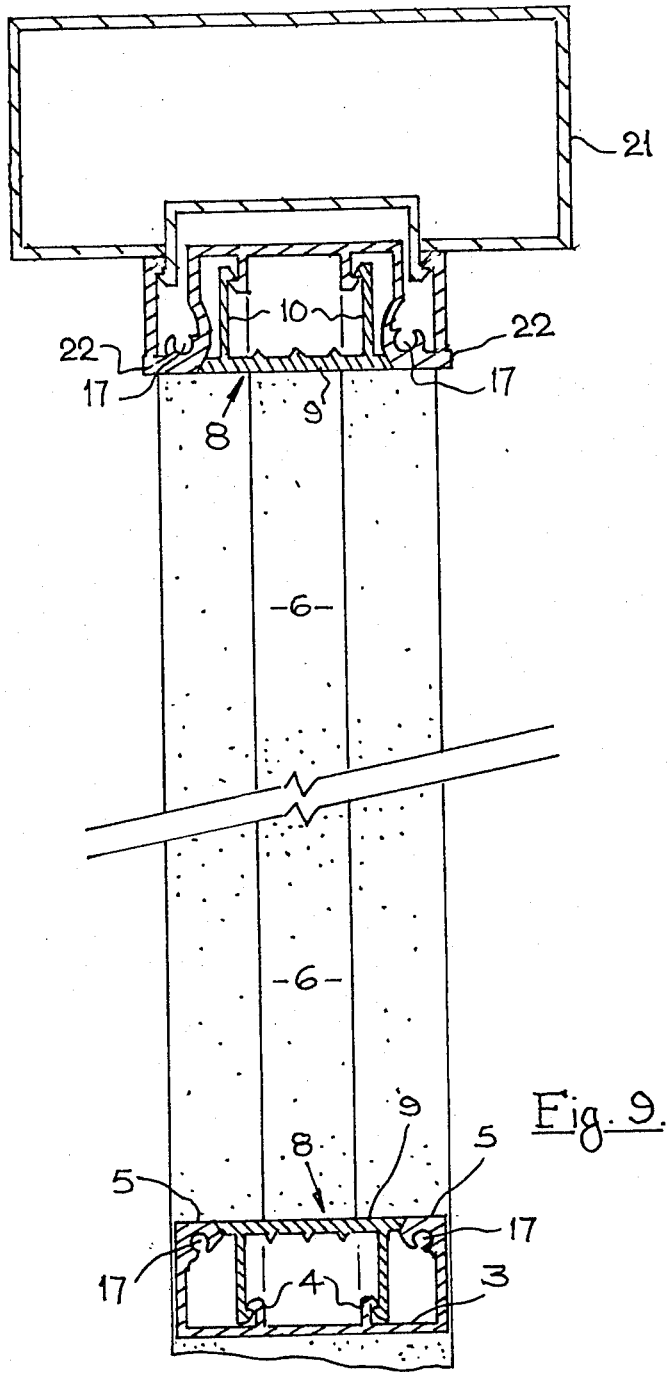
FIG. 9 is a vertical cross-section through a balustrade unit of the third embodiment.
Figure 10:
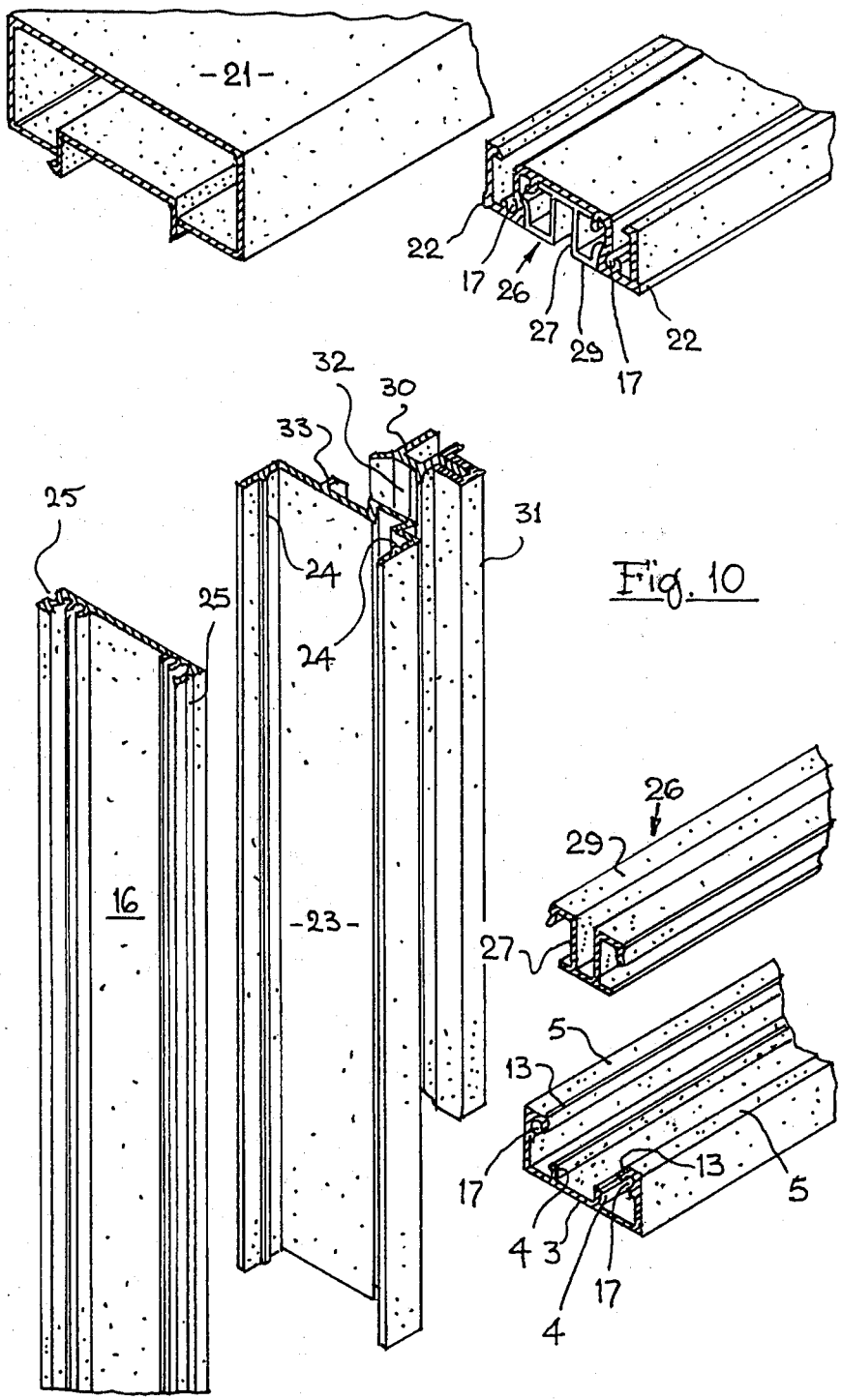
FIG. 10 shows how a glazing panel may be disposed between a pair of spaced-apart channel-section members.
Figure 11:
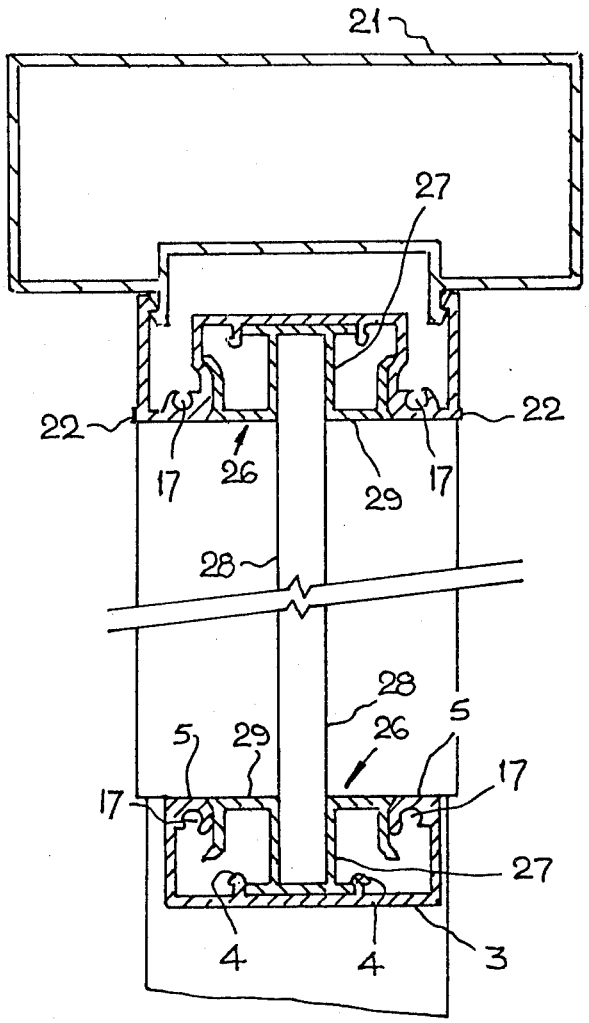
FIG. 11 is a vertical section through the third embodiment together with a glazing panel.

The mouth of each channel-section member, whether the interchangeable pair 1,2 or the modified top channel-section members as shown in FIGS. 7 to 11, is of great advantage in that it will also accept a system of glazing strip members to permit the easy assembly of 'push-up-drop-down' glazing panels. FIGS. 10, 11 and 12 illustrate this embodiment in some detail. Prior art systems do exist but are generally not applicable to an efficient four-sided glazing arrangement. However, such an arrangement is rendered possible in accordance with the present invention which employs glazing strips between which glazing panels, of glass or plastics material, are disposable. As is best to be seen in FIG. 10, there are provided glazing adaptor pieces 23 which are adapted to 'snap-fit' onto newel posts 15,16 via beads 24 (see FIG. 10) which engage with grooves 25 in the newel post half-sections. The horizontal glazing strips 26, preferably formed from PVC or the like, each have lips 27 between pairs of which a glazing panel 28 is receivable. Glazing strips 26 fit into the mouths of the top and bottom channel-section members and have outwardly-turned flanges 29 which effectively enclose the spaces between glazing panel 28 and the longitudinally-extending flanges of the top and bottom channel-section members.

Vertical glazing strips are composed of two parts 30 and 31 which together provide a pair of lips between which the glazing panels 28 are receivable. Vertical glazing strips 30,31, again preferably formed from PVC or the like, are provided with a pair of 'ears' 32 which snap-in to a re-entrant element 33 on glazing adaptor pieces 23.

To assemble a glazed balustrade unit, horizontal glazing strips 26 are installed in the mouths of the top and bottom channel-section members and part 30 of the vertical glazing strips is engaged with glazing adaptor pieces 23, which are in turn engaged with a newel post half-section. Glazing panel 28 is then 'push-up-drop-down' fitted between the lips of the horizontal glazing strips 26 and beds against part 30 of the vertical glazing strips. The co-acting push-on parts 31 are then applied without a bonding agent. The parts 31 do not bear any load but merely hold the vertical edges of the glazing panel to make a complete four-sided glazing seal.

Figure 13:
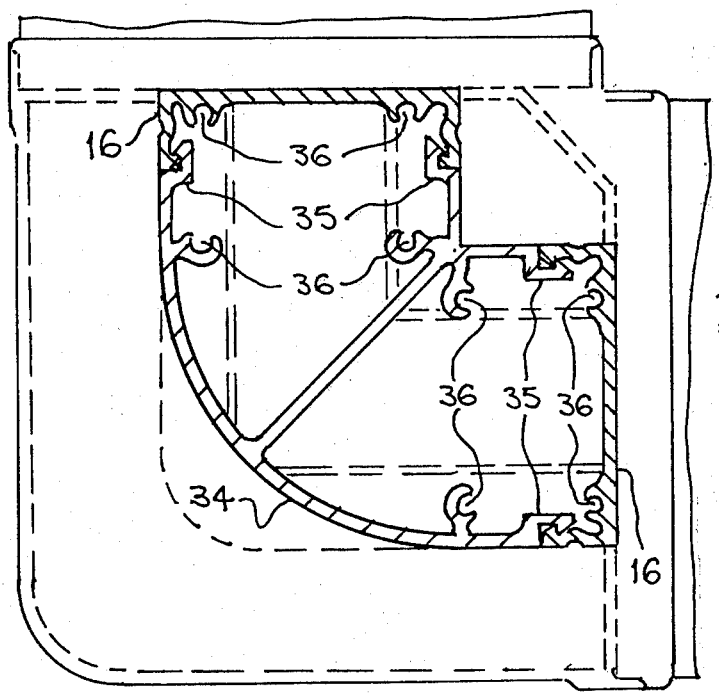
FIG. 13 shows, in cross-section, a corner post arrangement.

FIG. 13 shows a cross-section of a corner-post arrangement particularly suited to the embodiment illustrated in FIGS. 8 to 11. Such a corner-post 34 is an extrusion of aluminium or aluminium alloy and is provided with two pairs of female, 'snap-fit', longitudinally-extending engaging elements 35 which engage, in a manner previously described, with co-operating male newel post half-sections 16. A suitable metal or plastics capping member covers the top of corner-post 34, which, to this end, is provided with screw-flutes 36.

Figure 14:
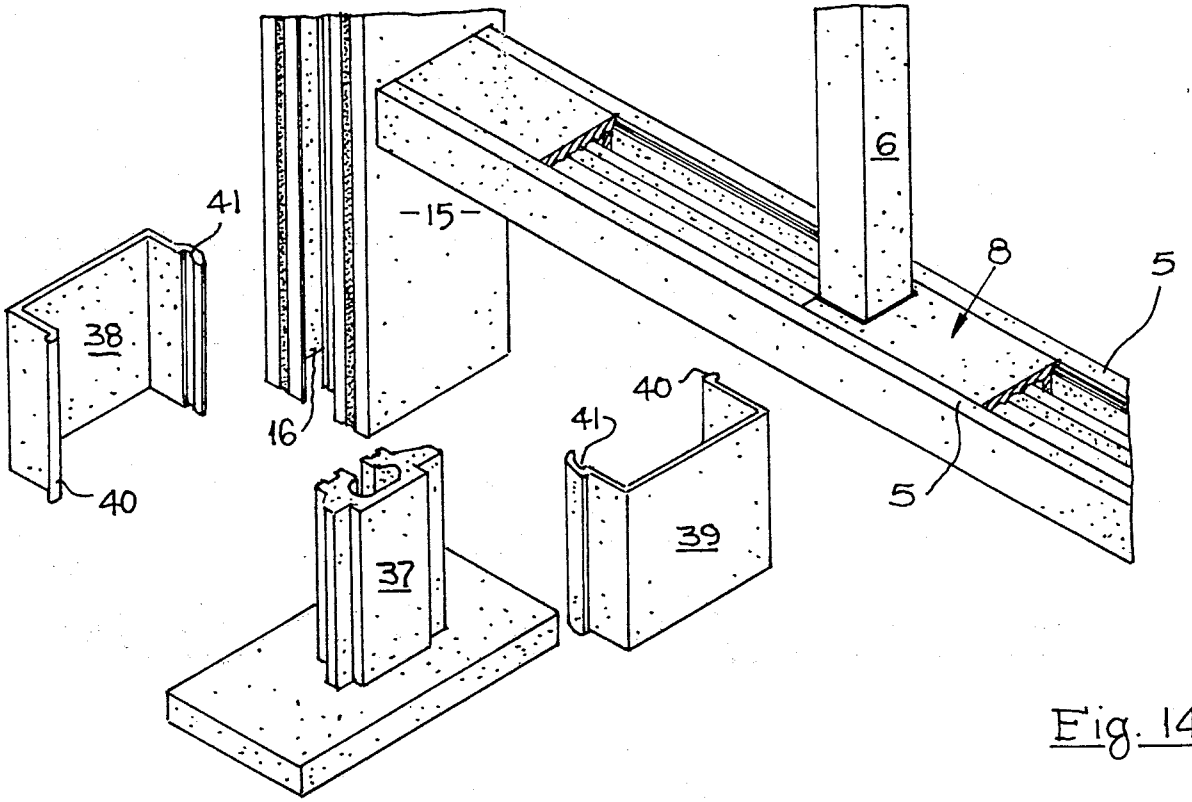
FIG. 14 illustrates a suitable fixing assembly for a newel post.

Finally, FIG. 14 illustrates a suitable fixing assembly for a newel post. A spigot 37, affixed to the structure upon which the balustrade unit is to be assembled, extends upwardly between the two half-sections 15,16 of a newel post. A complementary pair of cover pieces 38,39 is provided with male engaging-edges 40 and female engaging-edges 41 which snap together about newel post 15,16 and its centrally-located spigot 37 to hold the assembly in rattle-free engagement.

From the foregoing, it will be appreciated that balustrade units made according to the present invention ensure considerable cost savings from the use of ultra-light metal extruded members which have an eye appeal superior to previously-known balustrade units, and which not only weigh less but cost less for the finishing thereof because less anodising is necessary, as above described. Moreover, the use of hollow, uninterrupted sections as balusters ensures a great saving in fabrication cost and permits selection to be made from commercially available supplies.

The claims defining the invention are as follows:

1. A balustrade unit comprising a pair of spaced-apart channel-section members, the mouths of which are directed towards each other, the free edges of each said channel-section member being bent so as to form a pair of longitudinally-extending flanges, and a pair of longitudinally-extending, spaced-apart engaging elements provided on and upstanding from the base portion of each said channel-section member; a plurality of balusters disposable between said channel-section members, each baluster having, adjacent each end thereof, a transverse slot, the two slots in each baluster being in the same side thereof and parallel, and the ends of said balusters being receivable between said engaging elements when said balusters are in position between said channel-section members; and a plurality of spacers each one of which extends between adjacent balusters of said balustrade unit, each said spacer having a table portion the side edges of which are receivable in rebates in said longitudinally-extending flanges, and a pair of valances disposed normal to said table portion and adapted to irremovably engage with said engaging elements when said spacer is disposed between adjacent balusters, each said table portion including a bight the base of which is receivable in a said transverse slot and the limbs of which extend on either side of the baluster to enclose the space between a baluster and a longitudinally-extending flange.

2. The balustrade unit as claimed in claim 1, wherein one of said pair of channel-section members is provided with an integral handrail portion on that side of said channel-section member remote from the mouth thereof.

3. The balustrade unit as claimed in any one of the preceding claims, wherein said longitudinally-extending engaging elements of said channel-section members are alternatively engagable with a respective one of a pair of glazing strips between which a glazing panel is disposable, each said glazing strip having a pair of lips between which an edge of said glazing panel is receivable and a pair of outwardly turned flanges which extend on either side of said lips to enclose the space between glazing panel and longitudinally-extending flanges of said channel-section members.

4. The balustrade unit as claimed in claim 1, wherein the pair of longitudinally-extending flanges of one of said channel-section members is turned first outwardly and then upwardly, the free edges of said flanges constituting longitudinally-extending handrail-engaging elements; and wherein there is provided a box-section handrail having longitudinal-extending elements thereon adapted to irremovably engage with said handrail-engaging elements of said outwardly and upwardly turned flanges.

5. The balustrade unit as claimed in any one of claims 2 or 4, wherein a newel post is provided at each end of said balustrade unit, each said post being composed of two mating half-sections which irremovably engage with each other to thus form said newel post, each said newel post being securable to its associated channel-section members by means of self-tapping screws which extend through holes in said half-sections and are receivable in registering screw-flutes in said channel-section members.

6. A balustrade unit comprising a pair of spaced-apart channel-section members, the mouths of which are directed towards each other, the free edges of each said channel-section member being bent so as to form a pair of longitudinally-extending flanges, and a pair of longitudinally-extending, spaced-apart engaging elements provided on and upstanding from the base portion of each said channel-section member, one of said pair of channel-section members being provided with an integral handrail portion on that side of the channel-section member remote from the mouth thereof; a plurality of balusters disposable between said channel-section members, each baluster having, adjacent each end thereof, a transverse slot, the two slots in each baluster being in the same side thereof and parallel, and the ends of said balusters being receivable between said engaging elements when said balusters are in position between said channel-section members; a plurality of spacers each one of which extends between adjacent balusters of said balustrade unit, each said spacer having a table portion the side edges of which are receivable in rebates in said longitudinally-extending flanges, and a pair of valances disposed normal to said table portion and adapted to irremovably engage with said engaging elements when said spacer is disposed between adjacent balusters, each said table portion including a bight the base of which is receivable in a said transverse slot and the limbs of which extend on either side of the baluster to enclose the space between the baluster and longitudinally-extending flange; and a newel post provided at each end of said balustrade unit, each said post being composed of two mating half-sections which irremovably engage with each other to thus form said post, each said post being securable to its associated channel-section members by means of self-tapping screws which extend through holes to said half-sections and are receivable in registering screw-flutes in said channel-section members; all said irremovable engagements between mating parts being brought about by hooked, co-acting engagement elements which are 'snap-fitted' together so that disengagement cannot be achieved without loss of integrity in the fit between said mating parts.

7. The balustrade unit as claimed in claim 6, wherein said longitudinally-extending engaging elements of said channel-section members are alternatively engageable with a respective one of a pair of glazing strips between which a glazing panel is disposable, each said glazing strip having a pair of lips between which an edge of said glazing panel is receivable, and a pair of outwardly-turned flanges which extend on either side of said lips to enclose the space between a glazing panel and longitudinally-extending flanges of said channel-section member.

8. The balustrade unit as claimed in claim 7, wherein said channel-section members, balusters, handrails, spacers and newel post half-sections are fabricated from extruded aluminum or aluminum alloy.

9. A balustrade unit comprising a pair of spaced-apart channel-section members, the mouths of which are directed towards each other, the free edges of each said channel-section member being bent so as to form a pair of longitudinally-extending flanges, and a pair of longitudinally-extending, spaced-apart engaging elements provided on and upstanding from the base portion of each said channel-section member, the pair of longitudinally-extending flanges of one of said channel-section members being turned first outwardly and then upwardly, the free edges of said flanges constituting longitudinally-extending handrail-engaging elements, there being provided a box-section handrail having longitudinally-extending elements thereon adapted to irremovably engage with said handrail-engaging elements of said outwardly and upwardly turned flanges; a plurality of balusters disposable between said channel-section members, each baluster having, adjacent each end thereof, a transverse slot, the two slots in each baluster being in the same side thereof and parallel, and the ends of said balusters being receivable between said engaging elements when said balusters are in position between said channel-section members; a plurality of spacers each one of which extends between adjacent balusters of said balustrade unit, each said spacer having a table portion the side edges of which are receivable in rebates in said longitudinally-extending flanges, and a pair of valances disposed normal to said table portion and adapted to irremovably engage with said engaging elements when said spacer is disposed between adjacent balusters, each said table portion including a bight the base of which is receivable in a said transverse slot and the limbs of which extend on either side of the baluster to enclose the space between baluster and longitudinally-extending flange; and a newel post provided at each end of said balustrade unit, each said post being composed of two mating half-sections which irremovably engage with each other to thus form said newel post, each said post being securable to its associated channel-section members by self-tapping screws which extend through holes in said half-sections and are receivable in registering screw-flutes in said channel-section members; all said irremovable engagements between mating parts being brought about by hooked, co-acting engagement elements which are 'snap-fitted' together so that disengagement cannot be achieved without loss of integrity in the fit between said mating parts.

10. The balustrade unit as claimed in claim 9, wherein said longitudinally-extending engaging elements of said channel-section members are alternatively engageable with a respective one of a pair of glazing strips between which a glazing panel is disposable, each said glazing strip having a pair of lips between which an edge of said glazing panel is receivable, and a pair of outwardly-turned flanges which extend on either side of said lips to enclose the space between glazing panel and longitudinally-extending flanges of said channel-section members.

11. The balustrade unit as claimed in claim 10, wherein said channel-section members, balusters, handrails, spacers and newel post half-sections are fabricated from extruded aluminum or aluminum alloy.

* * * * *